US011399616B2

(12) United States Patent
Petrov

(10) Patent No.: US 11,399,616 B2
(45) Date of Patent: Aug. 2, 2022

(54) MULTI CONTAINER DISPENSING ARRANGEMENT

(71) Applicant: Kirill Petrov, Sydney (AU)

(72) Inventor: Kirill Petrov, Sydney (AU)

( * ) Notice: Subject to any disclaimer, the term of this patent is extended or adjusted under 35 U.S.C. 154(b) by 204 days.

(21) Appl. No.: 16/500,402

(22) PCT Filed: Apr. 3, 2018

(86) PCT No.: PCT/AU2018/050306
§ 371 (c)(1),
(2) Date: Oct. 3, 2019

(87) PCT Pub. No.: WO2018/184064
PCT Pub. Date: Oct. 11, 2018

(65) Prior Publication Data

US 2021/0100334 A1 Apr. 8, 2021

(30) Foreign Application Priority Data

Apr. 5, 2017 (AU) ..... 2017901250

(51) Int. Cl.

| | |
|---|---|
| ***A45D 34/06*** | (2006.01) |
| ***A45D 40/18*** | (2006.01) |
| ***A45D 40/24*** | (2006.01) |
| ***A45D 44/18*** | (2006.01) |
| ***A47K 5/18*** | (2006.01) |

(Continued)

(52) U.S. Cl.
CPC ..... *A45D 34/06* (2013.01); *A45D 40/18* (2013.01); *A45D 40/24* (2013.01); *A45D 44/18* (2013.01); *A47K 5/18* (2013.01); *B05B 11/3028* (2013.01); *B65D 21/0204* (2013.01); *B65D 21/0237* (2013.01)

(58) Field of Classification Search
CPC ..... A45D 34/06; A45D 40/18; A45D 40/24; A45D 44/18; A45D 34/00; A47K 5/18; B65D 21/0204; B65D 21/0237; B05B 11/3028; B05B 11/3033; B05B 11/3035; B05B 11/3036; B05B 11/3081; A46B 15/0061; A46B 15/0055
USPC ..... 222/192
See application file for complete search history.

(56) References Cited

U.S. PATENT DOCUMENTS 251,566 A * 12/1881 Fuller ..... B65D 1/04 215/6
1,964,362 A * 6/1934 Nassif ..... B05B 11/06 222/136

(Continued)

*Primary Examiner* — Patrick M. Buechner

(57) ABSTRACT

A multi-container dispenser for storing hygiene product, is disclosed. The dispenser comprises a plurality of storage reservoirs and an elongate receptacle body. The storage reservoir is configured to store fluids such as shampoo, and the elongate receptacle body is configured to store hygiene product such as tooth brush. Further, the storage reservoir comprises a dispensing outlet. A resealable cap disposed over each storage reservoir, such that each cap is selectively unsealed and resealed by a user. The dispenser comprises a dispensing arrangement in fluid communication with the plurality of storage reservoir, which is configured for actuation by the user, thereby causes dispensing of fluid from the selected storage reservoir. The storage reservoir being selected by the user by unsealing the selected respective sealable cap.

8 Claims, 9 Drawing Sheets

(51) Int. Cl.
*B05B 11/00* (2006.01)
*B65D 21/02* (2006.01)

(56) References Cited

U.S. PATENT DOCUMENTS 3,194,426 A * 7/1965 Brown, Jr. ..... B65D 21/0204 220/23.4
3,590,989 A * 7/1971 Wittwer ..... B65D 23/12 206/568
3,955,715 A * 5/1976 Topor ..... A47K 5/12 222/143
4,549,674 A * 10/1985 Alticosalian ..... B65D 83/205 222/135
4,932,563 A * 6/1990 Diamond ..... A45F 3/16 222/129
4,969,587 A * 11/1990 Miller ..... A45D 34/00 132/315
5,007,540 A * 4/1991 Beasley ..... A45C 7/0045 206/38
5,065,875 A * 11/1991 Balavich ..... B65D 23/12 215/10
5,115,916 A * 5/1992 Beasley ..... A45C 7/0045 206/504
5,152,431 A * 10/1992 Gardner ..... B05B 11/3081 222/136
5,316,159 A * 5/1994 Douglas ..... B65D 21/0204 206/432
5,316,398 A * 5/1994 Chandaria ..... B65D 21/0237 132/297
5,487,877 A * 1/1996 Choi ..... A47K 5/00 222/192
6,145,515 A * 11/2000 Wu ..... A45D 33/00 132/294
6,415,624 B1 * 7/2002 Connors ..... B65D 21/0237 62/457.3
6,659,311 B2 * 12/2003 Prueter ..... B05B 11/3081 222/136
6,895,628 B1 * 5/2005 Anderson ..... A45D 40/12 132/313
D829,568 S * 10/2018 Vlahakis ..... D9/743
2002/0079333 A1 * 6/2002 Neal ..... A47L 17/00 222/192
2005/0000968 A1 * 1/2005 Lowance ..... B29C 49/0073 220/500
2007/0090077 A1 * 4/2007 Graber ..... B65D 21/0237 215/10
2014/0217120 A1 * 8/2014 Berry ..... B05B 11/3081 222/136
2014/0263448 A1 * 9/2014 Erskine-Smith ... B65D 21/0201 222/143
2015/0266043 A1 * 9/2015 Liu ..... A45D 34/00 222/135
2016/0037892 A1 * 2/2016 Facer ..... A45D 34/00 206/581
2016/0198874 A1 * 7/2016 Pisarevsky ..... A61J 7/04 206/217
2017/0087922 A1 * 3/2017 Dorpmund ..... B43K 8/024
2017/0095054 A1 * 4/2017 Facer ..... B65D 23/12

* cited by examiner

MULTI CONTAINER DISPENSING ARRANGEMENT

CROSS-REFERENCE TO RELATED APPLICATIONS

This application claims priority to Australian Provisional Patent Application No. 2017901250, titled "MULTI CONTAINER DISPENSING ARRANGEMENT" and filed on the Australian Patent and Trademark Office on Apr. 5, 2017, and claims priority to Patent Cooperation Treaty (PCT) Application No. PCT/AU2018/050306 filed on Apr. 3, 2018. The specification of the above referenced patent application is incorporated herein by reference in its entirety.

BACKGROUND OF THE INVENTION

A. Technical Field

The present invention relates to a multi container dispensing arrangement and in particular to a multi container dispensing arrangement for storing and dispensing a plurality of fluid products such as shampoo or articles such as tooth brush.

B. Description of Related Art

Dispensing container are commonly used for dispensing fluid products, such as hygiene products, and in particular shampoo, conditioner and soap. Such products are typically stored in individual dispensing containers in the user's bathroom at home, and when the users expect to use such products outside of the home, for example at gym, or when camping, these products are typically brought with as individual containers.

However, bringing such separate individual fluid dispensing containers is inconvenient as it may be bulky and create excessive weight in, for example gym bags or travel bags. Tt may also be difficult to find containers dispersed individually inside a bag. Further, such individual fluid dispensing containers such as shampoo and conditioner may not fit conveniently into single toiletry bags.

It is to be understood that, if any prior art information is referred to herein, such reference does not constitute an admission that the information forms part of the common general knowledge in the art in any country.

SUMMARY OF THE INVENTION

It is an object of the present invention to provide a multi container dispensing arrangement which overcomes or at least partially ameliorates some of the abovementioned disadvantages or which at least provides the public with a useful choice.

The present invention discloses a multi-container dispenser or dispensing apparatus. According to an embodiment of the present invention, the multi-container dispenser or dispensing arrangement comprises, a plurality of storage containers. Each container being formed to include a hollow body portion to store fluid or any other articles. The multi-container dispenser further comprises an elongate receptacle body, configured to store one or more articles. The multi-container dispenser further comprises a selecting arrangement and a dispensing arrangement. The selecting arrangement is configured to receive input from a user to select the storage container from which fluid is to be dispensed. The dispensing arrangement is in fluid communication with each storage container for dispensing fluid from the storage container. Further, the dispensing arrangement is configured to actuate, thereby dispensing the fluid from the selected storage reservoir.

In some embodiments, the article is any storable article, but not limited to toothbrush, mirrors, or shaving kit. Each container comprises a plurality of engaging members and a plurality of complementary engaging members. In one embodiment, the plurality of container interconnects via the plurality of engaging member and the plurality of complementary engaging member to form a box like shape dispenser with a recess at rear side of the dispenser. In on embodiment, the elongate receptacle body is disposed within the recess at the rear side of the box like shape dispenser.

In one embodiment, each storage container comprises a one-way valve member, configured to allow flow of fluid through the valve in one direction and preventing flow of fluid in the opposite direction. The dispensing arrangement comprises a plurality of nozzles configured to engage the one-way valve member of each storage container. Further, the one-way valve is configured to prevent leakage of fluids from the storage container on disengagement of storage container from the dispensing arrangement.

In some embodiments, the dispensing arrangement is a manually manipulatable pump. The dispensing arrangement is located centrally with respect to the storage containers. In one embodiment, the dispensing arrangement comprises a resilient chamber for manual manipulation by the user. In some embodiments, the selecting arrangement comprises a fluid closure.

In one embodiment of the present invention, each fluid closure is movable between an open position to allow fluid flow through the closure, and a closed position to restrict fluid flow through the closure. The closed position of closure is resistant to pressure from within the storage container. The fluid closure is pivotally movable between the open and closed position. In some embodiments, each container comprises a compartment closure configured to pivotally movable between open and closed portion. In one embodiment, the open position of compartment closure enables the user to fill the storage container with the fluid. In another embodiment, the closed position of compartment closure secures the fluid within the storage container preventing leakage.

According to another embodiment of the present invention, the multi-container dispenser or dispensing arrangement comprises, a plurality of storage containers, each container being formed to include a hollow body portion to store fluid, an elongate receptacle body configured to store an article, a resealable cap disposed over each storage reservoir, wherein each cap is selectively unsealed and resealed by a user, and a dispensing arrangement in fluid communication with the plurality of storage container. The dispensing arrangement is configured to be actuated by the user, thereby causes dispensing of fluid from the selected storage container, and the storage container being selected by the user by unsealing the selected respective scalable cap.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

Other objects, features and advantages of the present invention will become apparent from the following detailed description. Tt should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The embodiments herein will be better understood from the following detailed description with reference to the drawings, in which.

DETAILED DESCRIPTION OF EMBODIMENTS

Figure 1:
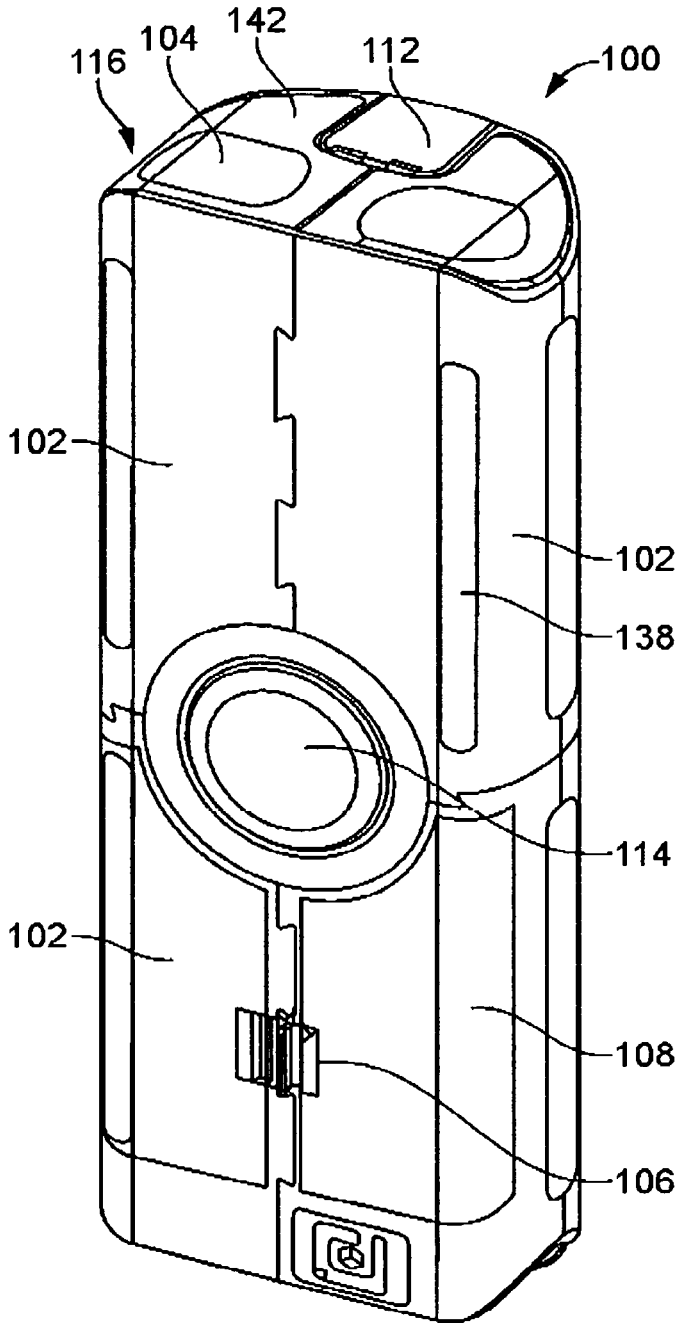
FIG. 1 shows a top front perspective view of a multi-container dispenser in an embodiment of the present invention.

A description of embodiments of the present invention will now be given with reference to the Figures. It is expected that the present invention may be embodied in other specific forms without departing from its spirit or essential characteristics. The described embodiments am to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention discloses a multi-container dispenser 100, shown in FIG. 1-FIG. 4. The multi-container dispenser or dispensing arrangement 100 comprises, a plurality of storage containers 102. Each container, reservoir or compartment 102 being formed to include a hollow body portion to store fluid or any other articles. The multi container dispenser 100 further comprises a selecting arrangement 116 and a dispensing arrangement 114. The selecting arrangement 116 is configured to receive input from a user to select the storage container 102 from which fluid is to be dispensed. The dispensing arrangement 114 is in fluid communication with each storage container 102 for dispensing fluid from the storage container 102. Further, the dispensing arrangement 114 is configured to actuate, thereby dispensing the fluid from the selected storage reservoir or container 102.

It is further envisaged that each one of the storage reservoirs 102 comprises a transparent outer viewing window 138 through which the level of the fluid in the storage container 102 is visible. In some embodiment, the storage containers 102 is composed entirely of a transparent material.

Figure 2:
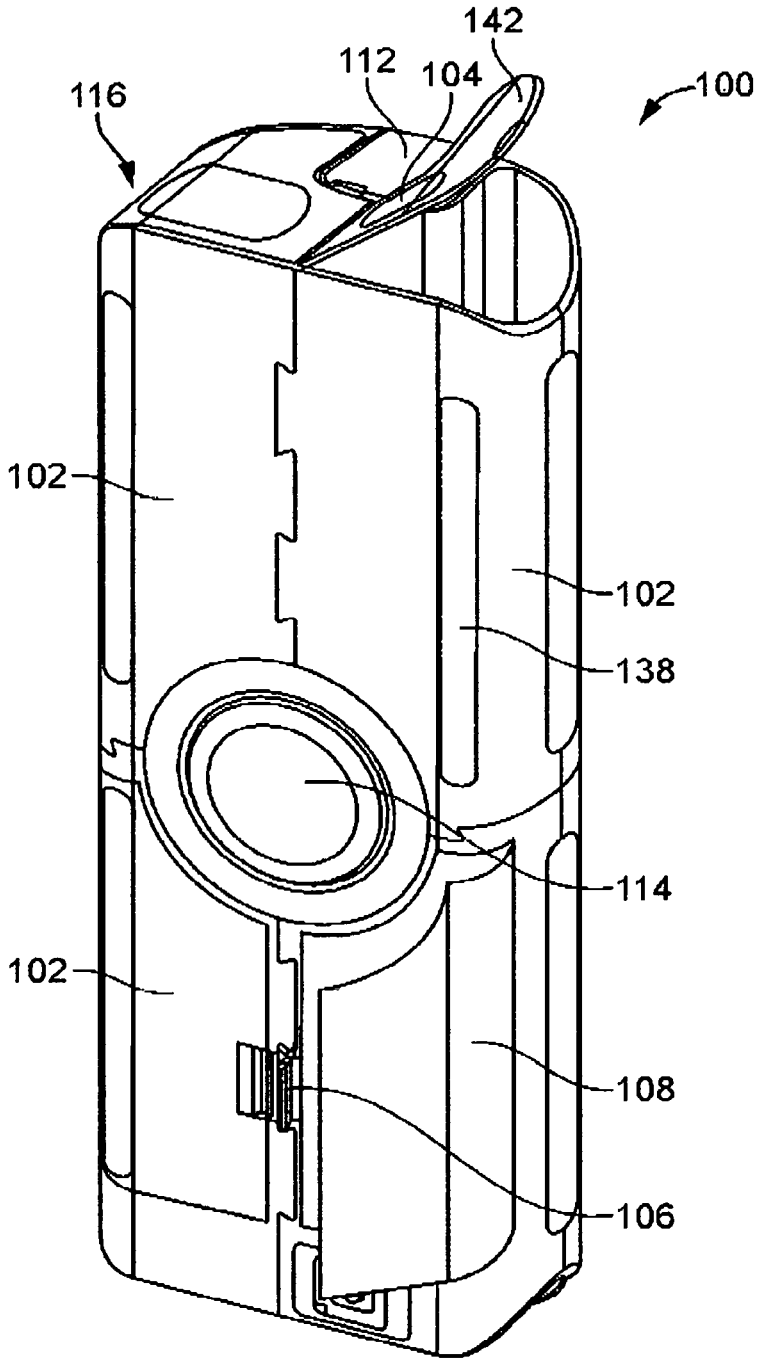
FIG. 2 shows a storage container of the multi-container dispenser in open position in an embodiment of the present invention.

FIG. 2 shows a storage container 102 of the multi-container dispenser 100 in open position in an embodiment of the present invention. The selecting arrangement 116 is configured for receiving input from a user to select the storage reservoir 102 from which fluid is to be dispensed. It is envisaged that in a preferred embodiment, the selecting arrangement 116 will preferably be a fluid closure 104 or a resealable cap associated with each of the storage reservoirs 102. The fluid closures 104 can be moved between an open position and a closed position, preferably in a pivotable manner, for example on a hinge or flap, to pivot about pivot axis. When the fluid closure 104 is in its open position, the dispensing outlet of the storage reservoir 102 that is associated with the fluid closure 104 is unrestricted and allows fluid flow from the storage reservoir 102 out of the dispensing outlet. When the fluid closure 104 is in its closed position, the flow of fluid out of the dispensing outlet will be at least restricted, and preferably scaled in an airtight or watertight fashion. In a preferred embodiment, it is envisaged that the fluid closures 104 will be adapted and configured to be resistant to being opened by pressure in the fluid within the storage container 102.

It will be appreciated by person skilled in the art that each of the fluid closures 104 shown in the figures are independently operable of each other, although this need not necessarily be the case, and in an alternative embodiment (not shown) movement of one closure to its open position can automatically cause operation of a mechanism to control movement of the other closures to their closed position.

In some embodiments, each container 102 comprises a compartment closure 142 configured to pivotally movable between open and closed portion. In one embodiment, the open position of compartment closure 142 enables the user to fill the storage container 102 with the fluid. In another embodiment, the closed position of compartment closure 142 secures the fluid within the storage container 102 preventing leakage.

Figure 3:
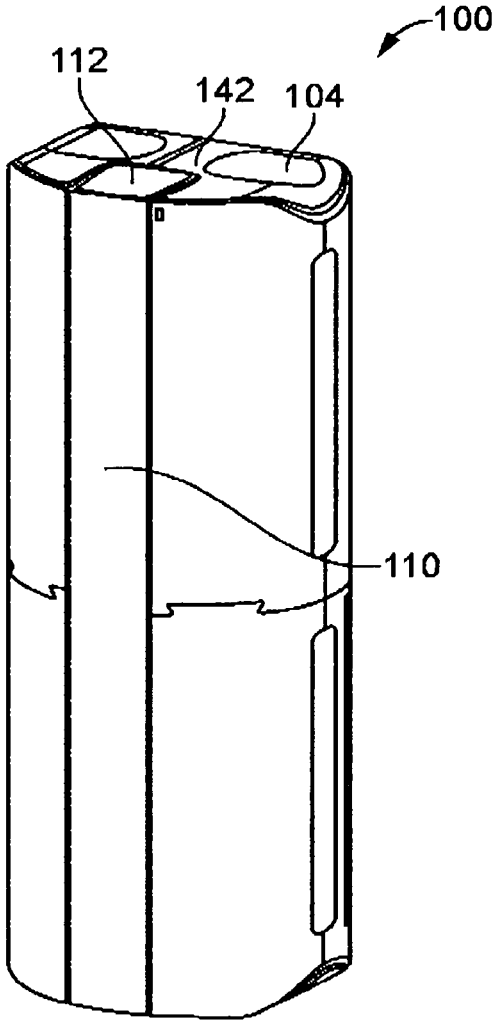
FIG. 3 shows a top rear perspective view of the multi-container dispenser in an embodiment of the present invention.
Figure 4:
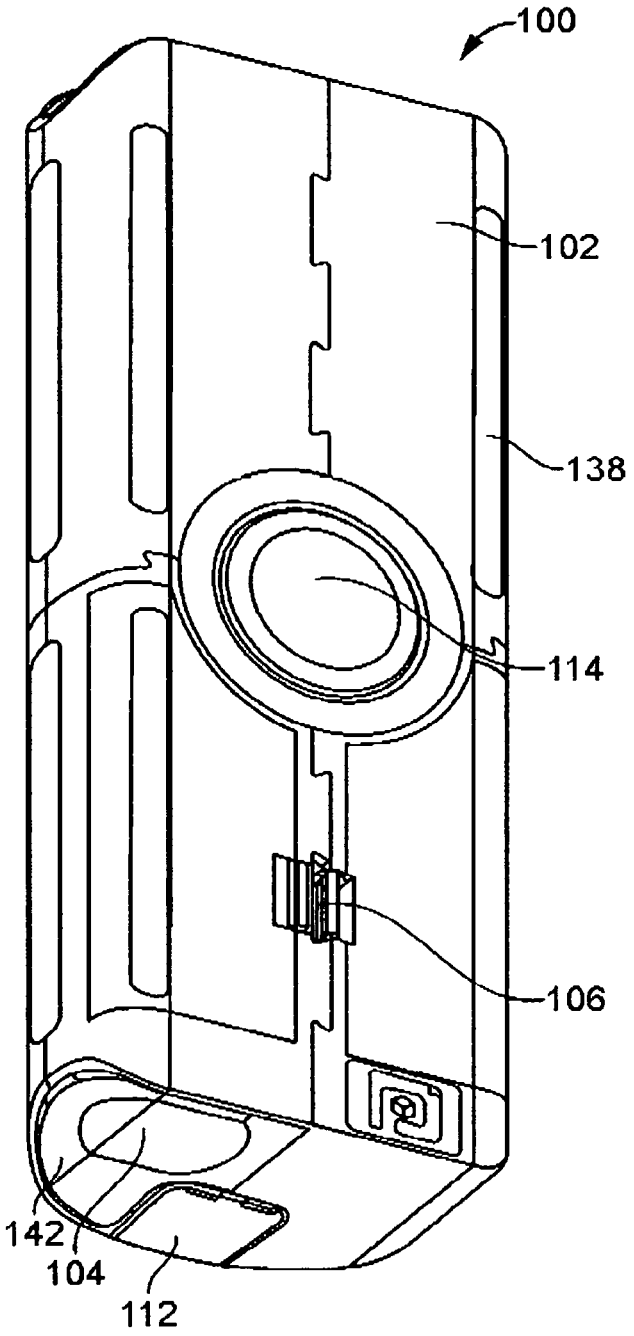
FIG. 4 shows a bottom front perspective view of the multi-container dispenser in an embodiment of the present invention.

FIG. 3 shows a top rear perspective view of the multi-container dispenser in an embodiment of the present invention. The multi-container dispenser 100 further comprises an elongate receptacle body 110, configured to store one or more articles. The elongated receptacle body 110 is accessed by opening the closure portion 112. Referring to FIG. 2 and FIG. 4, the multi-container dispenser 100 further comprises dry containers 109 configured for containing solid items such as jewelry, toothbrushes, or the like. Each dry container 10N defines one or more storage compartments or recesses, which are accessible by access hatch 106.

Figure 5:
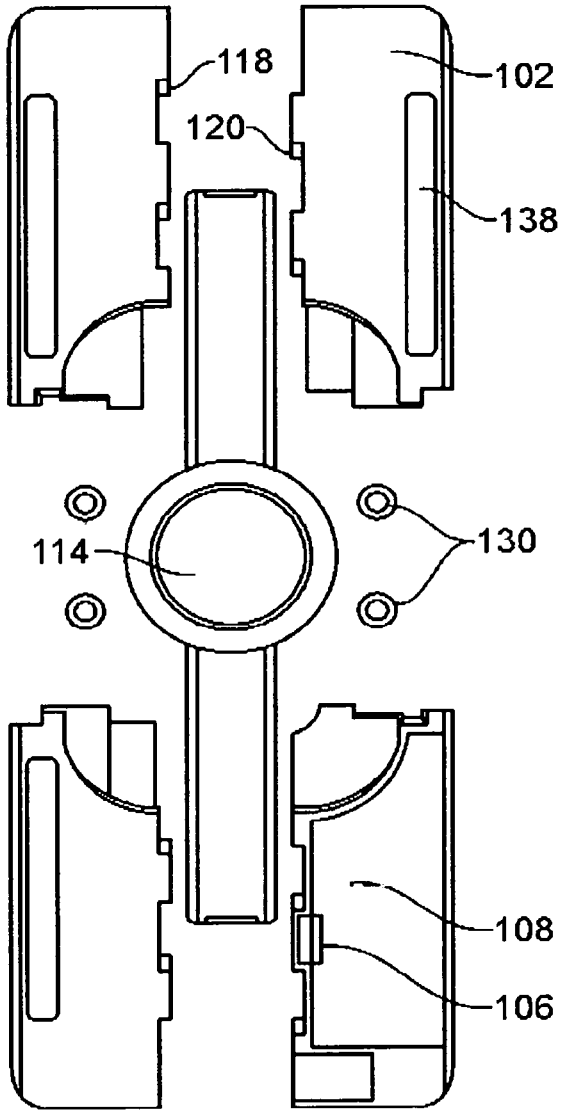
FIG. 5 shows an exploded view of the multi-container dispenser in an embodiment of the present invention.

FIG. 5 shows an exploded view of the multi-container dispenser 100 in an embodiment of the present invention. Each container 102 comprises a plurality of engaging members 118 and a plurality of complementary engaging members 120. In one embodiment, the plurality of container 102 interconnects via the plurality of engaging member 118 and the plurality of complementary engaging member 120 to form a box like shape dispenser with a recess at rear side of the dispenser 100. In one embodiment, the elongate receptacle body 110 is disposed within the recess at the rear side of the box like shape dispenser 100.

In one embodiment, each storage container 102 comprises a one-way valve member 130, configured to allow flow of fluid through the valve 130 in one direction and preventing flow of fluid in the opposite direction. The dispensing arrangement 114 comprises a plurality of nozzles 122, shown in FIG. 8, configured to engage the one-way valve member 130 of each storage container 102. Further, the one-way valve 130 is configured to prevent leakage of fluids from the storage container 102 on disengagement of storage container 102 from the dispensing arrangement 114.

Figure 6:
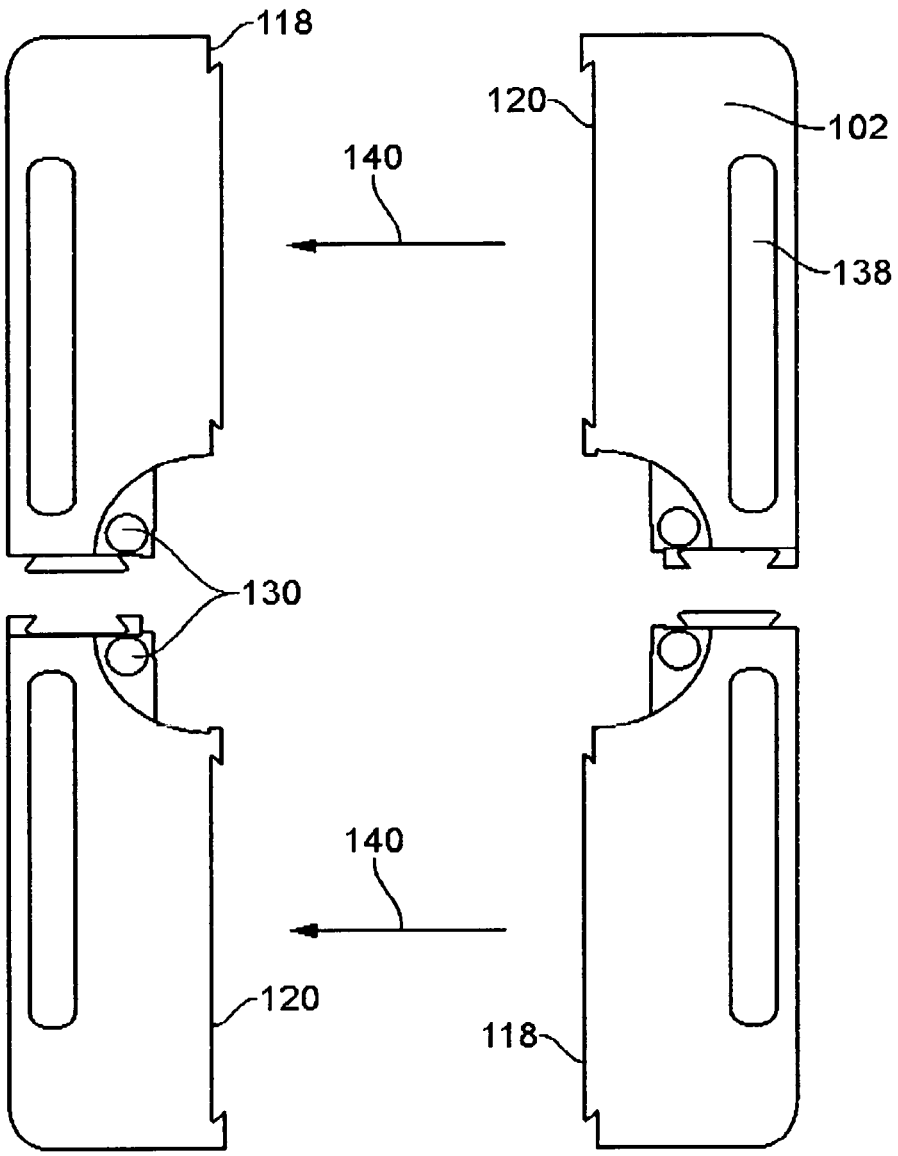
FIG. 6 and FIG. 7 shows interconnection of plurality of storage container of the multi-container dispenser in an embodiment of the present invention.
Figure 7:
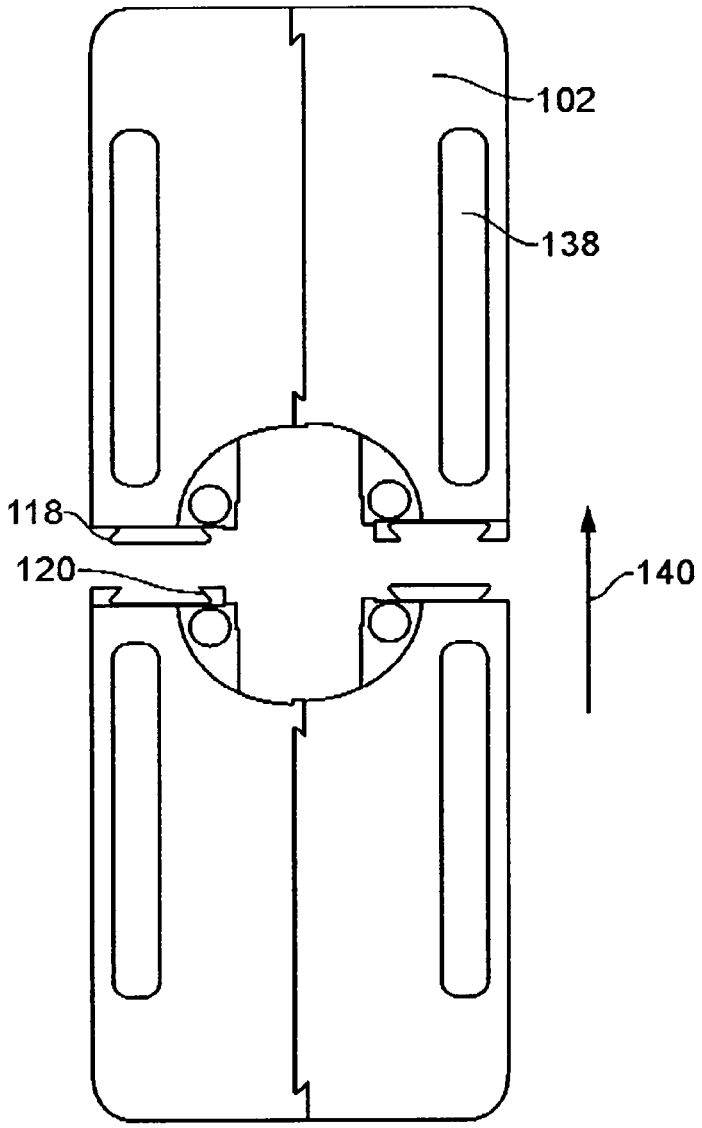

FIG. 6 and FIG. 7 shows interconnection of plurality of storage container of the multi-container dispenser in an embodiment of the present invention. The storage reservoir 102 comprise connecting formations, preferably in the form of snap fit-type formations, for securely receiving and securing one or more storage reservoirs 102 and allowing for their convenient release and removal. It will be appreciated by those skilled in the art that a wide variety of shapes and configurations of connecting formations are possible that would allow for securing the storage reservoirs 102. The interconnection of plurality of storage container of the multi-container dispenser is represented by arrow 140.

Figure 8:
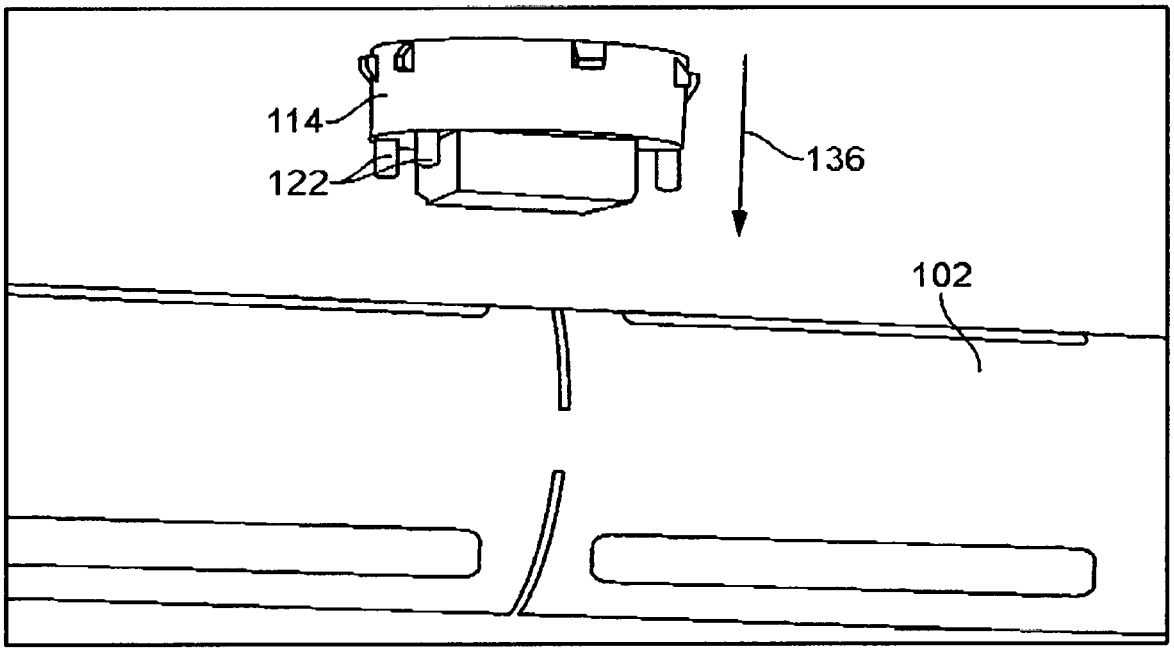
FIG. 8 shows exploded view of dispensing arrangement of the multi-container dispenser in an embodiment of the present invention.

FIG. 8 shows exploded view of dispensing arrangement 114 of the multi-container dispenser 100 in an embodiment of the present invention. The dispensing arrangement 114 is configured for actuation by a user to dispense fluid from the storage reservoir 102 that has been selected. In the embodiments, the dispensing arrangement 114 comprises a manually manipulatable pump that is composed of resilient material such as rubber, silicone or other similar resilient plastics and defines a resilient chamber internally. The pump is centrally located with respect to the storage reservoirs 102, so that it is directly adjacent each of the storage reservoirs 102. The resilient pump is preferably configured as a compressible button that can be pushed or actuated by a user by manual manipulation to compress air within the chamber. The dispensing arrangement 114 further comprises plurality of nozzle 122. The plurality of nozzles 112 is configured to engage the one-way valve member 130 of each storage container 102, represented by arrow 136.

It will be appreciated that alternative embodiments may be possible. For example, in one embodiment (not shown) the dispensing arrangement need not necessarily be a manually manipulatable pump, but could instead be an electronically actuated pump, utilizing an electric motor to drive a small pump. In another alternative embodiment, it is envisaged that the dispensing arrangement need not necessarily utilize a pump formation composed of a resilient material, and could instead use a spring biased actuation button, where by pushing the activation button down has the same effect as pushing down the resilient pump.

For an example, one pump herein could be utilized for all storage reservoirs 102 (for example, 1 to 4 chambers, depending on the number of chambers attached). One set of users might want to have only one liquid chamber or storage reservoirs 102 and other storage reservoirs 102 with different functionalities. Further, another set of users might want to attach 4 liquid storage reservoirs 102, where the pump is used for all four storage reservoirs 102. In one embodiment, the pump is operated by means of an elastic pump button and one-way valves. One umbrella valve is used for suction of air inside the pump cavity, and duckbill valves are attached to storage reservoirs 102 that let the air inside the storage reservoirs 102 to push liquids out of storage reservoirs 102.

Figure 9:
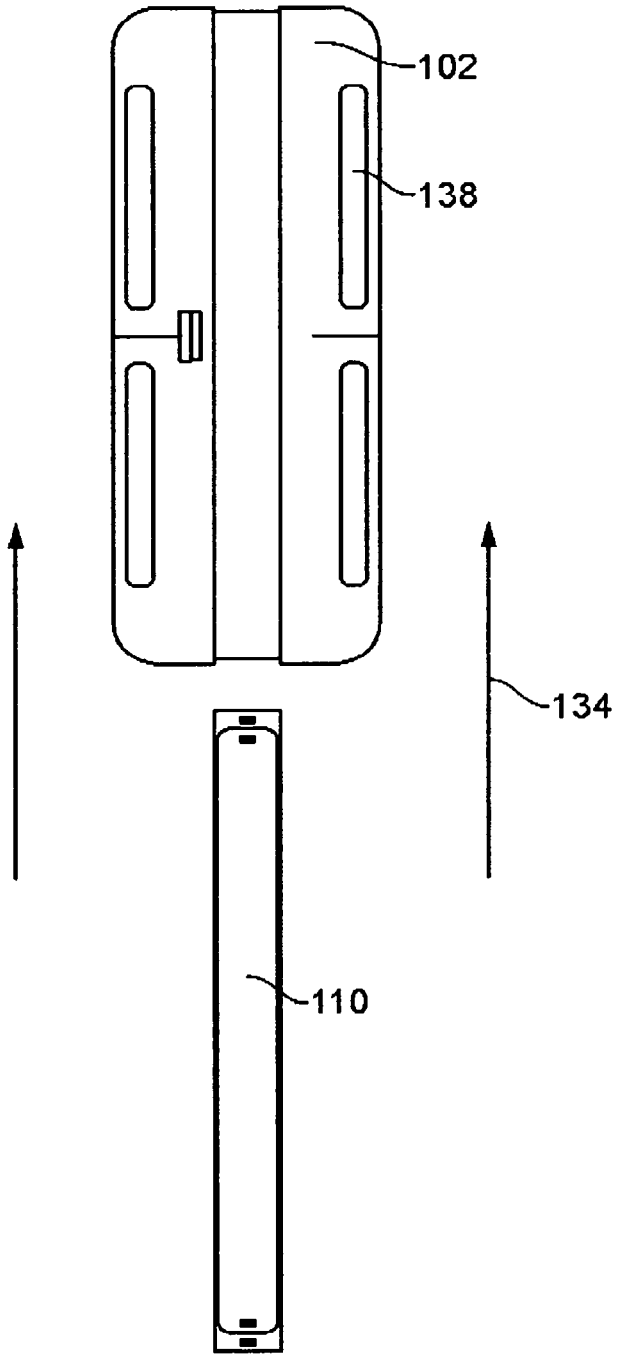
FIG. 9 shows assembly of elongated receptacle body of the multi-container dispenser in an embodiment of the present invention.

FIG. 9 shows assembly of elongated receptacle body of the multi-container dispenser 100 in an embodiment of the present invention. The elongate receptacle body 110 is disposed within the recess at the rear side of the box like shape dispenser, represented by arrow 134.

In another embodiment, it is envisaged that the multi container dispensing arrangement 100 can include at least one electronic device. The electronic device can include, for example a speaker and/or media player and/or radio. The electronic device is preferably waterproof, for example for use in a shower. It is envisaged that the electronic device can be configured for connection to another electronic device, such as a media player, for example through a hard-wired connection and/or wireless communication such as Wi-Fi, Bluetooth or the like. Further and/or alternatively, the electronic device can be received or receivable within a storage compartment or container 102 and/or dry compartment 106. In this way, any combination of electronic devices can be attached to the multi-container dispenser 100.

In another embodiment (not shown), the multi-container dispensing arrangement 100 for dispensing fluids, the dispenser 100 comprising: a plurality of storage reservoirs 102 suitable for storing a plurality of fluids simultaneously, each storage reservoir 102 comprising a dispensing outlet; each storage reservoir including a resealable cap for scaling the respective fluids in each storage reservoir 102 wherein each cap is selectively unsealed and resealed by a user, and a dispensing an arrangement 114 configured for actuation by the user to thereby cause the dispensing of fluid from the selected storage reservoir 102, the storage reservoir 102 being selected by the user by unsealing the selected respective scalable cap. Preferably the dispensing arrangement 114 is an air pump. Preferably the dispensing arrangement is a mechanical air pump that is actuated by the user. Preferably the mechanical air pump is an accordion type or bellows type air pump.

Although a single embodiment of the invention has been illustrated in the accompanying drawings and described in the above detailed description, it will be understood that the invention is not limited to the embodiment developed herein, but is capable of numerous rearrangements, modifications, substitutions of parts and elements without departing from the spirit and scope of the invention.

The foregoing description comprises illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. A multi-container dispenser, comprising:

a. a plurality of storage containers, each storage container being formed to include a hollow body portion to store fluid, wherein each storage container comprises a one-way valve member configured to allow flow of fluid through the valve in one direction and preventing flow of fluid in the opposite direction, and each storage container comprises a compartment closure configured to be pivotally movable between open and closed positions, wherein the open position of the compartment closure enables a user to fill the storage container with the fluid and the closed position of the compartment closure secures the fluid within the storage container preventing leakage;

b. an elongate receptacle body configured to store one or more articles;

c. a selecting arrangement configured for receiving input from the user to select the storage container from which fluid is to be dispensed, wherein the selecting arrangement comprises a fluid closure, movable between an open position to allow fluid flow through the fluid closure, and a closed position to restrict fluid flow through the fluid closure, and d. a dispensing arrangement in fluid communication with each storage container for dispensing fluid from the storage container, wherein the dispensing arrangement is configured for actuation by the user thereby causing the dispensing of fluid from the selected storage container and wherein the dispensing arrangement is a manually manipulatable pump, which comprises a resilient chamber, located centrally with respect to the storage container.

2. The multi-container dispenser of claim 1, wherein the article is a tooth brush.

3. The multi-container dispenser of claim 1, wherein the dispensing arrangement comprises a plurality of nozzles, each respective nozzle configured to engage the one-way valve member of a respective one of the plurality of storage containers.

4. The multi-container dispenser of claim 1, wherein each one-way valve is configured to prevent leakage of fluids from a respective one of the plurality of storage containers on disengagement thereof from the dispensing arrangement.

5. The multi-container dispenser or claim 1, wherein the fluid closure is pivotally movable between the open and closed positions.

6. The multi-container dispenser of claim 1, wherein each storage container comprises a plurality of engaging members and a plurality of complementary engaging members.

7. The multi-container dispenser of claim 6, wherein the plurality of storage container interconnects via the plurality of engaging members and the plurality of complementary engaging members to form a box shaped dispenser with a recess at a rear side of the dispenser.

8. The multi-container dispenser of claim 7, wherein the elongate receptacle body is disposed within the recess at the rear side or the box shaped dispenser.

* * * * *